United States Patent [19]

Storcel

[11] 4,290,662

[45] Sep. 22, 1981

[54] CONNECTOR ASSEMBLY WITH VISUAL, TACTILE AND AUDIBLE INDICATION

[75] Inventor: Joseph A. Storcel, North Riverside, Ill.

[73] Assignee: Bunker Ramo Corporation, Oak Brook, Ill.

[21] Appl. No.: 56,663

[22] Filed: Jul. 11, 1979

[51] Int. Cl.[3] ..... H01R 4/30

[52] U.S. Cl. ..... 339/89 M; 339/113 R; 339/DIG. 2

[58] Field of Search ..... 339/113 R, 89 R, 89 M, 339/90 R, 91 R, DIG. 2; 151/13; 285/81, 82, 87, 88, 93; 248/315; 292/256.6; 70/456, 450

[56] References Cited

U.S. PATENT DOCUMENTS

| | | | |
|---|---|---|---|
| 1,024,274 | 9/1912 | Miller | 151/13 |
| 1,338,181 | 4/1920 | Kalkbrenner | 70/458 |
| 3,008,116 | 11/1961 | Blanchenot | 339/90 |
| 3,191,972 | 6/1965 | Collar | 285/93 |
| 3,281,757 | 10/1966 | Bonhomme | 339/91 |
| 3,343,852 | 9/1967 | Blight et al. | 285/82 |
| 3,552,777 | 1/1971 | Heinrich et al. | 285/81 |
| 3,555,490 | 1/1971 | Williams | 339/91 R |
| 3,587,032 | 6/1971 | Normann | 339/89 |
| 3,594,694 | 7/1971 | Clark | 339/45 M |
| 3,594,700 | 7/1971 | Nava et al. | 339/89 R |
| 3,646,495 | 2/1972 | Cowmeadow | 339/DIG. 2 |
| 3,669,472 | 6/1972 | Nadsady | 285/87 |
| 3,750,087 | 7/1973 | Vetter | 339/90 R |
| 3,777,523 | 12/1973 | Holland | 70/456 R |
| 3,786,396 | 1/1974 | Kemmer et al. | 339/89 R |
| 3,801,954 | 4/1974 | Dorrell | 339/90 R |
| 3,805,216 | 4/1974 | Gaspar et al. | 339/90 R |
| 3,808,580 | 4/1974 | Johnson | 339/89 R |
| 3,892,458 | 7/1975 | Clark | 339/90 R |
| 3,960,428 | 6/1976 | Naus et al. | 339/90 R |
| 3,971,614 | 7/1976 | Paoli et al. | 339/89 R |
| 4,030,798 | 6/1977 | Paoli | 339/89 R |
| 4,056,298 | 11/1977 | Cooper et al. | 339/90 R |
| 4,059,324 | 11/1977 | Snyder et al. | 339/89 M |
| 4,066,315 | 1/1978 | Arneson | 339/89 M |
| 4,074,927 | 2/1978 | Ball | 339/89 M |
| 4,076,361 | 2/1978 | Campbell | 339/75 M |

FOREIGN PATENT DOCUMENTS

| | | |
|---|---|---|
| 1665644 | 3/1971 | Fed. Rep. of Germany . |
| 2712836 | 9/1977 | Fed. Rep. of Germany . |
| 2726333 | 12/1978 | Fed. Rep. of Germany . |
| 2248460 | 5/1975 | France . |
| 2344148 | 10/1977 | France . |
| 468909 | 7/1937 | United Kingdom . |
| 825579 | 12/1959 | United Kingdom . |
| 1411067 | 10/1975 | United Kingdom . |

OTHER PUBLICATIONS

IBM Technical Disclosure Bulletin-vol. 1 No. 4 Dec. 1958, Clicking Connector-M. C. Panaro.

*Primary Examiner*—John McQuade
*Attorney, Agent, or Firm*—F. M. Arbuckle; J. R. Hoffman; N. A. Camasto

[57] ABSTRACT

A connector assembly is disclosed which includes first and second mating connector members, and a coupling ring carried by one of the connector members for moving the other connector member axially into mating relation therewith. A visual and tactile indicating assembly is operatively associated with the connector members and the coupling ring and includes a radially inwardly self-biased split indicating ring carried by the coupling ring. The indicating ring is movable radially relative to the coupling ring from a retracted position to an outwardly projecting indicating position in response to a predetermined positioning of the other connector member in relation to the one connector member and the coupling ring. The ring provides an omni-directional visual and tactile indication of the relative positioning of the mating connector members. The connector assembly also includes an audible indicating mechanism which provides a self-locking feature for the connector assembly.

35 Claims, 7 Drawing Figures

CONNECTOR ASSEMBLY WITH VISUAL, TACTILE AND AUDIBLE INDICATION

BACKGROUND AND SUMMARY OF THE INVENTION

This invention relates to coupling or connector assemblies, such as electrical connectors, fiber optic connectors, and the like, and is equally applicable for in-line connection as well as connection between a single conductor, fiber, or the like, to a terminal means.

More particularly, this invention relates to a connector which has a coupling member, such as a coupling ring, for mating a pair of connector members and providing visual, audible and tactile indication for determining if the connector assembly is functionally coupled.

Many attempts have been made to provide visual, audible and/or tactile means for indicating the mating condition of electrical connectors, fiber optic connectors, or the like. One of the principal problems in providing such indications is in the area of the visual indication. Audible indicating means normally have no directional limitations as to the positioning of the connector in relation to a user or operator. The same holds true for some tactile indicating means, because a user can, through some sort of manual manipulation, determine the functional condition of the connector when tactile indicating means are employed. However, visual indicating means heretofore provided in connector assemblies, or the like, are limited by the directional observational limitations of an individual.

For instance, prior U.S. Pat. Nos. 3,552,777 to Heinrich et al.; 3,786,396 to Kemmer; 3,801,954 to Dorrell; 3,808,580 to Johnson; and 4,059,324 to Snyder et al. all show various attempts to provide visual indication in an electrical connector for indicating the desired degree of tightness, for instance, between mated connectors.

More particularly, Kemmer 3,786,396 and Heinrich 3,552,777 show threaded electrical connectors which are provided with annular slots or windows in the coupling ring thereof through which a painted bright color on an axially movable inner member is observable. However, observation of this indication is limited by an observer having to be positioned substantially directly radially outwardly of a slot or window in order to observe the presence or absence of the inner color-coded visual indication. In both the Johnson 3,808,580 and Snyder 4,059,324 patents, ridges or projections are provided for observation through notches or slots and, again, the visual observation thereof is limited by the same positioning requirements of an observer as in the Heinrich patent. In Dorrell 3,801,954, an attempt is made to provide externally visible indication by means of applying heat to a metallic member so as to actually deform the member itself. Such a process is quite expensive in assembly and certainly is not at all applicable to field assembly and usage of the connector as is contemplated by the present invention.

The present invention, therefore, is directed to providing a new and improved connector assembly of the character described with visual, audible and tactile indicating means for determining the positioning of a pair of connector members, conductors, fibers, or the like.

A principal object of the invention is to provide a new and improved visual and tactile indicating means in a connector or coupling assembly.

A principal advantage of the invention is to provide such a visual and tactile indicating means which is omni-directional for observation by an individual from any direction regardless of the positioning of the connector.

In the exemplary embodiment of the invention, the indicating means thereof is disclosed in conjunction with an electrical connector assembly having first and second mating connector members, each connector member including engageable contact means adapted for axial connection in engagement with the contact means of the other connector member. However, it is contemplated that the invention is equally applicable for a wide variety of connector assemblies, such as fiber optic connectors, or the like. As disclosed herein, a rotatable coupling ring is carried by one of the connector members. The other connector member and the coupling ring have complementarily engageable releasable connecting means, such as screw threads, for moving the other connector member axially into mating relation with the one connector member. Of course, other engageable releasable connecting means, such as bayonet and pin connections or "snatch" connections, also are contemplated. Visual indicating means is associated with the coupling ring and is movable radially relative thereto from a retracted position to an indicating position projecting outwardly of the coupling ring in response to a predetermined positioning of the other connector member in relation to the coupling ring and the one mating connector member. The visual indicating means, when in its retracted position, is radially disposed at least within the adjacent peripheral bounds of the coupling ring and is progressively moved outwardly to its indicating position by the progressive coupling of the threaded coupling ring and the other connector member.

More particularly, the visual indicating means of the present invention includes a band-like member which is disposed within an outer circumferential groove of the coupling ring and extends substantially entirely about the coupling ring to provide an omni-directional visual indication of the relative positioning of the mating connector members. The band-like indicating member is in the form of a split ring which is self-biased radially inwardly toward its retracted position. Biasing means in the form of an inner cam ring is carried by the one connector member and has inclined cam ramps disposed thereon at an angle to the axis of the connector assembly. The cam ring is provided with limited axial movement relative to the one connector member. A plurality of ball bearings are disposed in radially open-ended bores in the coupling ring between the inner cam ring and the outer split indicating ring and engageable therewith for transmitting axial movement of the inner cam ring, resulting from abutment with the other connector member, to radial outward movement of the indicating ring to its indicating position. A spring wave washer is carried by the one connector member between an annular flange thereof and the cam ring to urge the cam ring in an axially outward non-indicating direction.

Detent means is provided between the cam ring and the one connector member providing an audible as well as tactile indication of the mating of the connector members, as well as providing a self locking feature for the connector assembly. More particularly, a plurality of detent recesses are disposed in a radially extending, inwardly facing surface of the cam ring. At least one detent protrusion is provided on the spring wave washer providing a ratcheting action with the detent recesses, as well as a self-locking feature when the spring wave washer is fully compressed.

With the visual indicating band in its radially protruding indicating position, not only is an omni-directional indicating means provided for the connector assembly, but the protruding band provides a ready tactile indication of the condition of the connector assembly.

The split indicating ring is overlapped substantially at its ends to provide a full 360° circumferential indicating surface therefor.

Other objects, features and advantages of the invention will be readily apparent from the following detailed description taken in connection with the accompanying drawings.

DETAILED DESCRIPTION OF THE INVENTION

Figure 1:
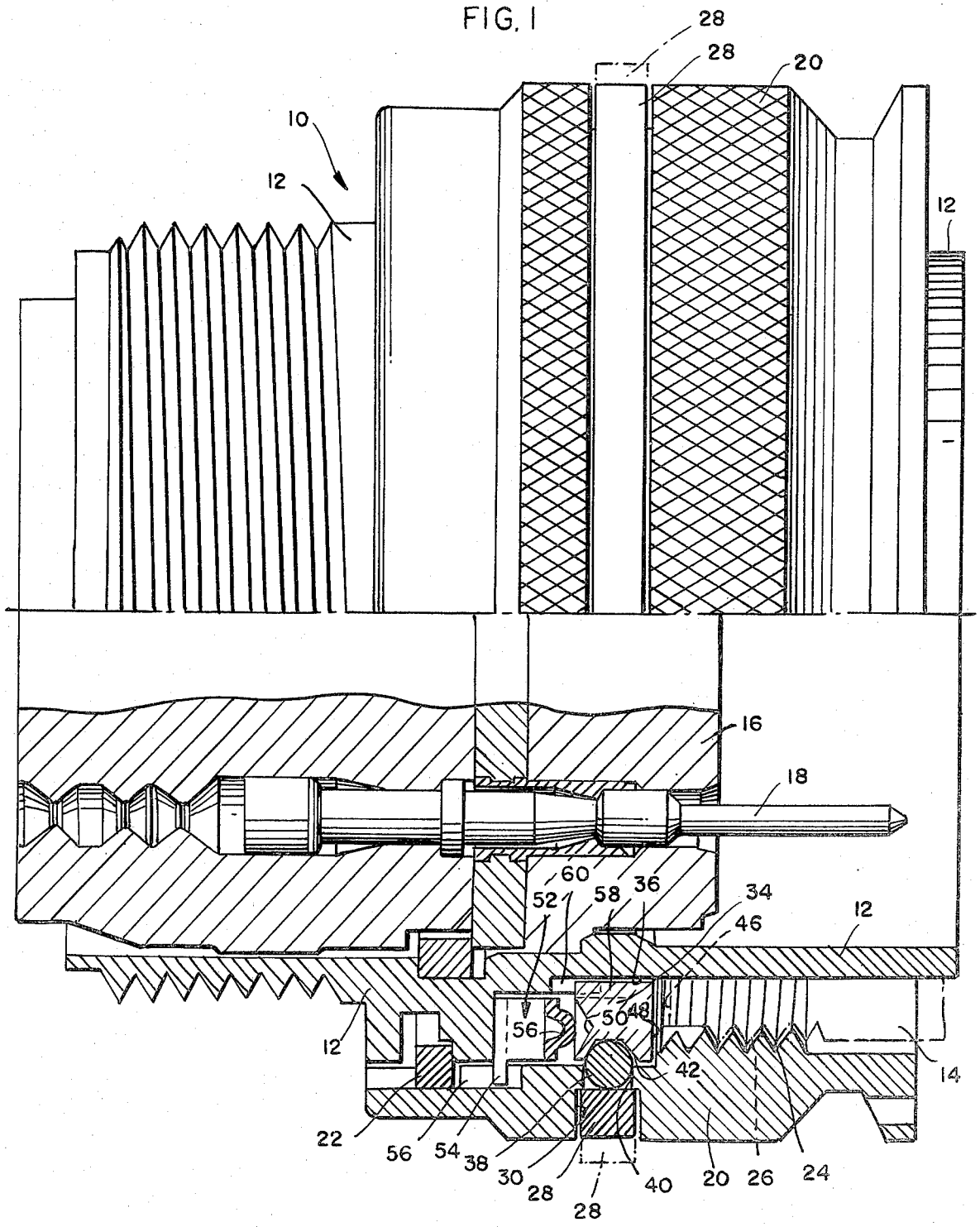
FIG. 1 is a partially fragmented and sectional view of the connector assembly of the present invention, showing the receptacle connector member in phantom and the protruding position of the indicating band in phantom.

Referring to the drawings in greater detail, the invention herein is disclosed as embodied in an electrical connector, generally designated 10 in FIG. 1. However, it should be understood that the invention is contemplated for a wide variety of applications such as in fiber optic connectors, and other connector assemblies.

Figure 2:
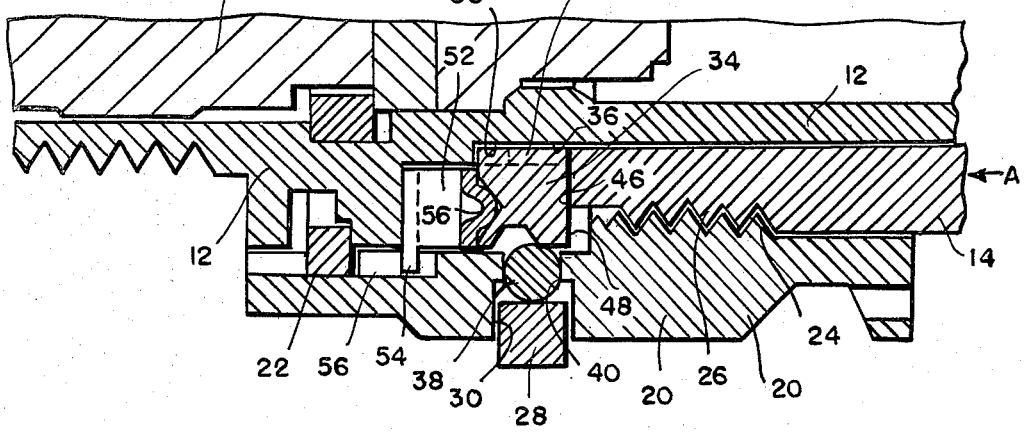
FIG. 2 is a partial axial sectional view, similar to that of FIG. 1, but with the receptacle connector member in fully mated position, and with the indicating means in its fully operative indicating position.
Figure 3:
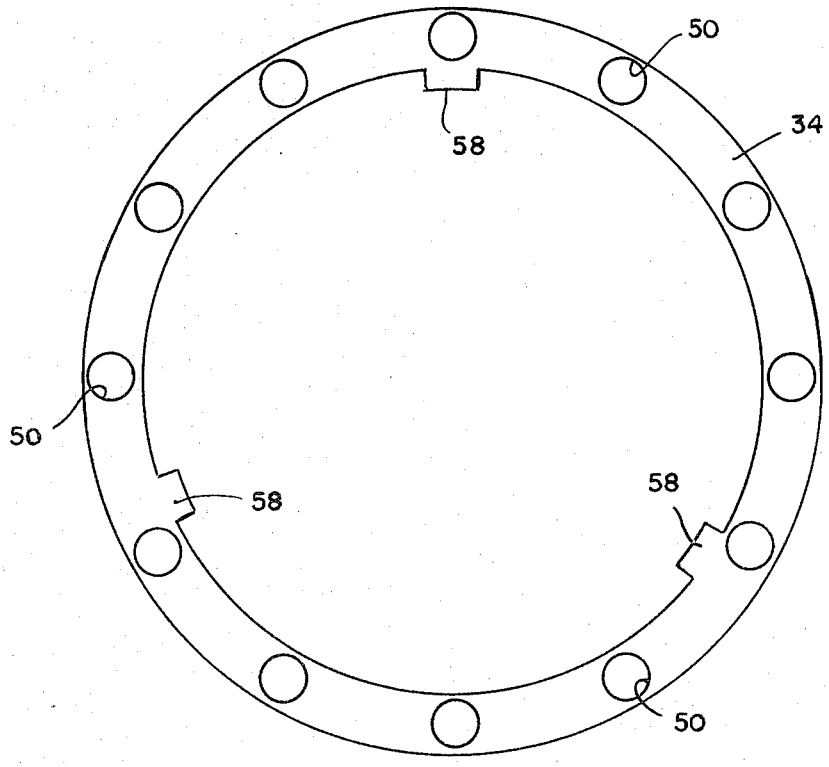
FIG. 3 is an axial elevational view of the inner face of the cam ring showing the detent recesses thereof.

The electrical connector assembly 10 shown in FIG. 1 includes a first or plug connector member 12 and a second or receptacle connector 14 (FIG. 2). The plug connector member 12 has an insert member 16, as is known, in which is disposed one or more electrical contacts, such as the pin contacts 18. The other connector member 14, as is known, also carries an insert member which houses receptacle contacts for receiving the pin contacts 18. The insert member and receptacle contacts for the other connector member 14 are known and are not shown in the drawings so as to facilitate the invention of the indicating means described hereinafter.

However, the connector members 12 and 14 are adapted for axial connection of the contact means thereof in engagement with the contact means of the other connector member.

More particularly, a coupling ring 20 is carried by the connector member 12 and is held in position thereon for rotation relative thereto by means of a retaining ring 22.

The connector member 14 (FIG. 2) and the coupling ring 20 have complementarily engageable releasable connecting means for moving the connector member axially into mating relation to the receptacle connector member 12. More particularly, the coupling ring 20 has internal threads 24 for cooperation with external threads 26 of the connector member 14 to draw the connector member axially into mating relation with the connector member 12. This draws the respective contact means of the connector members into mating engagement, and, as described below, effects movement or actuation of the visual, tactile and audible indicating means of the present invention.

Visual indicating means is provided and is associated with the coupling ring 20 and is movable radially relative thereto from a retracted position (FIG. 1) shown at least within the adjacent peripheral bounds of the coupling ring to a second, indicating position (FIG. 2) projecting outwardly of the coupling ring in response to the aforesaid positioning of the connector member 14 within the coupling ring.

Figure 6:
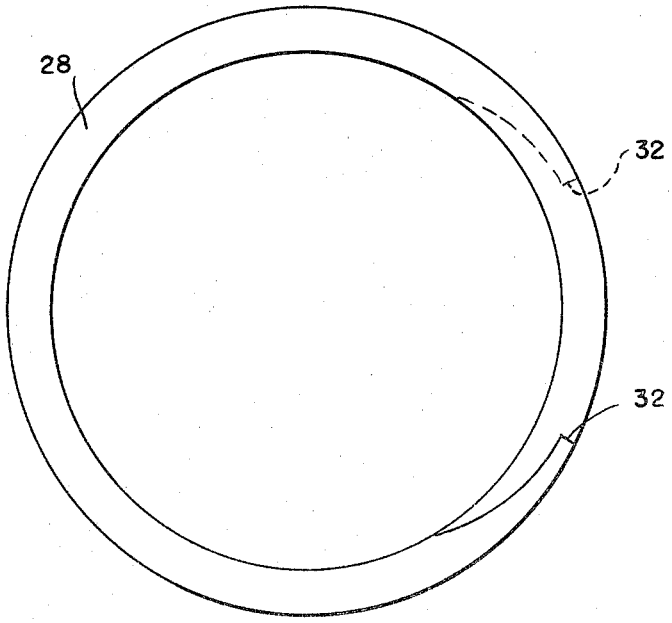
FIG. 6 is an axial elevational view of the split ring visual indicating band-like member of the present invention.
Figure 7:
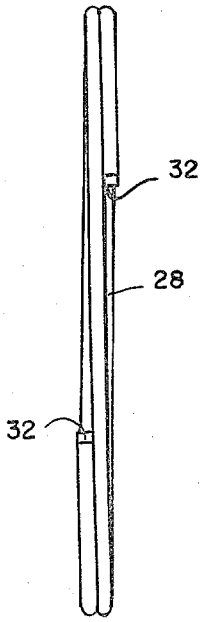
FIG. 7 is a side elevational view of the visual indicating band of FIG. 6.

More particularly, the visual indicating means of the present invention includes a band-like member 28 in the form of a slit ring which is disposed within an annular peripheral recess or groove 30 extending entirely about the outside of the coupling ring 20. The split indicating ring 28, as shown in FIGS. 6 and 7, is an interleaved, overlapping construction having free ends 32 so as to provide both a 360° visual indication, as well as to provide for the split indicating ring to be self-biased radially inwardly toward its retracted position. By means described in detail below, the indicating ring 28 is movable from a retracted, inwardly self-biased position shown in FIG. 1 to an outer expanded or protruding position shown in FIG. 2.

Means is provided for biasing the indicating ring 28 from its retracted position shown in FIG. 1 to its expanded position shown in FIG. 2, in response to axial mating movement of the connector member 14 toward the connector member 12, by the aforesaid threaded engagement with the coupling ring 20. More particularly, the biasing means includes a cam ring 34 disposed on the one connector member 12 and having limited axial movement relative thereto and relative to the coupling ring 20, within a groove 36 about the exterior of the connector member 12. A plurality of ball bearings 38 are disposed within respective ones of a plurality of radially open-ended bores 40 in the coupling ring 20. The open-ended bores 40 extend between the indicating ring 28 and the cam ring 34, and the ball bearings are engageable therewith for transmitting axial movement of the inner cam ring 34, due to abutment by the connector member 14, to radial outward movement of the indicating ring 28 toward its expanded position shown in FIG. 2. In order to facilitate transmitting axial movement of the inner cam ring to radial outward movement of the indicating ring, the cam ring 34 is provided with cam means in the form of an inclined cam ramp 42 for each of the ball bearings 38. The cam ramp 42, as seen in FIGS. 1 and 2, extends at an angle to the axis of the connector assembly. The cam ramp 42 may be provided by a continuous cam surface extending circumferentially about the outside of the cam ring 34, or, of course, other means may be provided such as inclined recesses or other means in the outer periphery of the cam ring.

In view of the foregoing, and referring to FIGS. 1 and 2, it can be seen that prior to threading the connector member 14 and the contact means thereof into engagement with the coupling ring 20, the indicating ring 28 is self-biased inwardly to a retracted position radially within the adjacent peripheral bounds of the coupling ring. The ball bearings 38 also are biased inwardly into the peripheral groove or recesses which define the cam ramp 42 in the periphery of the cam ring 34. In operation, as the connector member 14 is drawn axially into mating condition with the connector member 12, by means of the threads 24, 26 of the coupling ring 20 and the connector member 14, the inner face 46 of the connector member 14 abuts against the outer face 48 of the cam ring 34 and urges the cam ring to the left as viewed in FIGS. 1 and 2. As the cam ring 34 moves inwardly, or to the left as shown in FIGS. 1 and 2, the cam surfaces 42 engage the ball bearings 38 and bias the ball bearings outwardly into engagement with the inside of the indicating ring 28. Continued axial movement of the connector member 14 in an inwardly mating direction (see arrow A in FIG. 2) causes the cam ring 34 to continue to move axially inwardly until the cam ramp surface 42, through the ball bearings 38, moves the indicating ring 28 to its full indicating position shown in FIG. 2. The indicating ring also is shown in its full indicating position by the phantom lines in FIG. 1.

In the indicating position of the indicating ring 28 shown in FIG. 2, it is readily apparent that a full 360° omni-directional visual indication of the mating condition of the connector members is afforded. Regardless of the position of the connector, such as in confined conditions in the aircraft or other industries, the mating condition of the connector is readily observable. In addition, it can be seen that since the indicating ring 28 starts from a retracted position substantially within the adjacent peripheral bounds of the coupling ring 20, an unmated condition of the connector assembly also is readily apparent, as well as any condition of the mating connector members therebetween. Furthermore, with the indicating ring extending entirely about the connector assembly, ready tactile indication is afforded by a minimal amount of manual manipulation or touching of the connector assembly even if the connector assembly is hidden from view.

Figure 4:
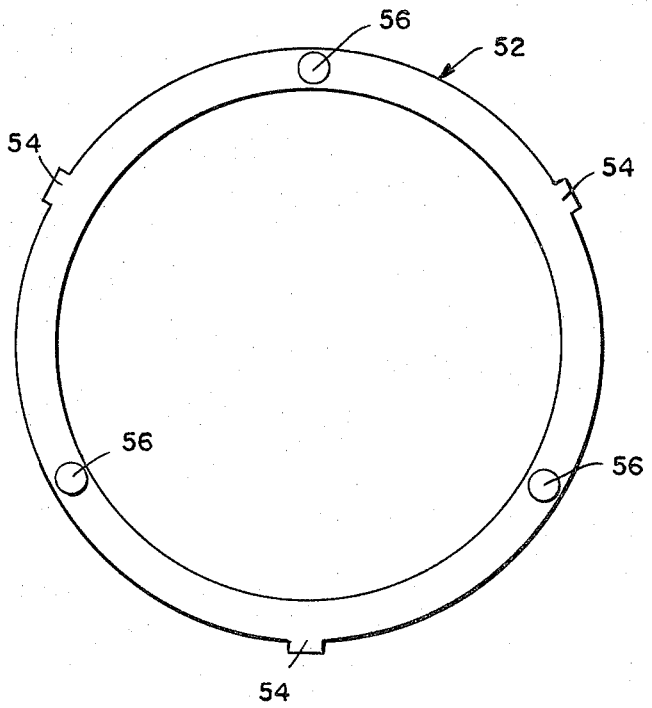
FIG. 4 is an axial elevational view of the spring wave washer showing the detent protrusions thereof.
Figure 5:
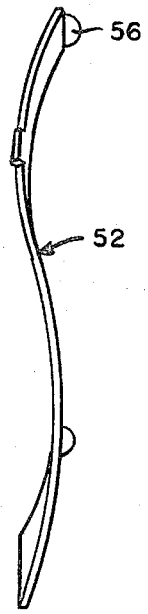
FIG. 5 is a side elevational view of the spring wave washer of FIG. 4.

A further feature of the invention is the provision of a self-locking feature for the connector assembly which, in addition, provides an audible indication of the mating of the assembly. More particularly, detent means is provided between the cam ring 34 and the one connector member 12. The detent means includes a plurality of detent recesses 50 formed in the axially inner face of the cam ring 34. A spring wave washer, generally designated 52 (see FIGS. 4 and 5), is carried by the coupling ring 20 on the inside thereof for rotation therewith. In particular, the spring wave washer 52 has a plurality of radially outwardly protruding keying tabs 54 which protrude into slots 56 on the inside of the coupling ring 20. The spring wave washer 52 has a plurality of integral detent protrusions 56 which cooperate with the detent recesses 50 of the cam ring 34 to provide a ratcheting action. As the connector member 14 is drawn axially into the coupling ring 20 as described above, and the connector member abuts against the cam ring 34 to move the cam ring axially inwardly, the detent protrusions 56 of the spring wave washer 52 enter the detent recesses 50 of the cam ring to provide said ratcheting action and an audible indication of the mating of the connector members. The cam ring 34 has a plurality of radially inwardly protruding keying tabs 58 which protrude into slots 60 on the outside of the connector member 12 to rotationally fix the cam ring relative thereto but permit the aforesaid axial movement relative thereto.

In addition, as the spring wave washer 52 is compressed by abutment of the mating end of the connector member 14 with the cam ring 34, the increased forces created thereby, in combination with the seating of the detent protrusions 56 of the spring wave washer within the detent recesses 50 of the cam ring 34, effects a self-locking condition for the connector assembly to prevent unintentional uncoupling of the connector members, such as under extreme vibration conditions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. In a connector assembly which includes first and second connector members adapted for mating engagement;

a coupling member for drawing said connector members into mating engagement; and indicating means associated with said coupling member and at least one of said connector members for movement between a first non-indicating position and a second indicating position in response to a predetermined positional relationship of said connector members, said indicating means when in one of said positions being disposed outside of and substantially entirely surrounding the peripheral bounds of the coupling member.

2. The connector assembly of claim 1 wherein said indicating means includes an outer band-like member extending circumferentially about said coupling member and movable between said positions so as to provide an omni-directional indication of the relative positioning of said mating connector members.

3. The connector assembly of claim 1 wherein said indicating means when in the other of said positions is disposed at least within the peripheral bounds of the coupling member.

4. In a connector assembly which includes first and second connector members adapted for mating engagement;

a coupling member for drawing said connector members into mating engagement;

indicating means associated with said coupling member and at least one of said connector members for movement between a first non-indicating position and a second indicating position in response to a predetermined positional relationship of said connector members, said indicating means when in one of said positions being disposed outside of and substantially entirely about the peripheral bounds of the coupling member;

said indicating means including an outer band-like member extending circumferentially about said coupling member and movable between said positions so as to provide an omni-directional indication of the relative positioning of said mating connector members; and an inner cam member carried by one of said connector members and engageable by the other connector member for biasing said band-like member from said non-indicating position to said indicating position in response to said predetermined positioning of said connector members.

5. The connector assembly of claim 4 wherein said band-like member extends substantially entirely about said coupling member and including a plurality of ball bearings disposed in radially open-ended bores in said coupling member between said inner cam member and said outer band-like member and engageable therewith for transmitting movement of said inner cam member in a mating direction to transverse movement of said band-like member toward said indication position.

6. The connector assembly of claim 5 wherein said band-like member comprises a split ring member which is self-biased inwardly toward a retracted position.

7. The connector assembly of claim 6 including spring means between said cam member and said one connector member.

8. The connector assembly of claim 4 including detent means between said cam member and said one connector member providing an audible indication of the mating relation of said connector members.

9. The connector assembly of claim 8 wherein said detent means includes a plurality of detent recesses disposed in a radially extending, inwardly facing surface of said cam member, and spring means on said one connector member having at least one detent protrusion providing a ratcheting self-locking action with said detent recesses.

10. In a connector assembly which includes first and second connector members, each connector member including mating means adapted for axial connection in engagement with the mating means of the other connector member;

a coupling ring carried by one of said connector members;

said other connector member and said coupling ring having complementarily engageable releasable connecting means for moving the connector members axially into mating relation with each other; and indicating means associated with said coupling ring and movable radially relative thereto between a first non-indicating position and a second indicating position in response to a predetermined positional relationship of said connector members, said indicating means when in one of said positions being disposed outside of and substantially entirely surrounding said coupling ring.

11. In a connector assembly which includes first and second connector members, each connector member including mating means adapted for axial connection in engagement with the mating means of the other connector member;

a coupling ring carried by one of said connector members;

said other connector member and said coupling ring having complementarily engageable releasable connecting means for moving the connector members axially into mating relation with each other; and indicating means associated with said coupling ring and movable radially relative thereto between a first non-indicating position and a second indicating position in response to a predetermined positional relationship of said connector members, said indicating means when in one of said positions being disposed outside of and substantially entirely about said coupling ring;

said indicating means when in the other of said positions being disposed at least within the adjacent peripheral bounds of said coupling ring.

12. In a connector assembly which includes first and second connector members, each connector member including mating means adapted for axial connection in engagement with the mating means of the other connector member;

a coupling ring carried by one of said connector members;

said other connector member and said coupling ring having complementarily engageable releasable connecting means for moving the connector members axially into mating relation with each other; and indicating means associated with said coupling ring and movable radially relative thereto between a first non-indicating position and a second indicating position in response to a predetermined positional relationship of said connector members, said indicating means when in one of said positions being disposed outside of and substantially entirely about said coupling ring;

said indicating means including an outer band-like member extending circumferentially about said coupling ring and movable between said positions so as to provide an omni-directional visual indication of the relative positioning of said mating connector members.

13. The connector assembly of claim 12 including means operatively associated between said band-like member and said other connector member for biasing said band-like member from said other position to said indicating position in response to said predetermined positioning of said other connector member.

14. The connector assembly of claim 13 wherein said biasing means includes cam means for biasing said band-like member in a radial direction in response to axial mating movement of said other connector member.

15. The connector assembly of claim 14 wherein said biasing means comprises an inner cam ring disposed on said one connector member with said cam means disposed thereon, the cam ring having limited axial movement relative to said one connector member.

16. The connector assembly of claim 15 wherein said band-like member comprises a split ring member extending substantially entirely about said coupling ring, the split ring member being self-biased radially inwardly toward said retracted position.

17. The connector assembly of claim 15 including at least one ball bearing disposed in a radially open-ended bore in said coupling ring between said inner cam ring and said outer band-like member and engageable therewith for transmitting axial movement of said inner cam ring to radial outward movement of said band-like member toward said indicating position.

18. The connector assembly of claim 17 wherein said band-like member extends substantially entirely about said coupling member, and including a plurality of ball bearings circumferentially spaced about said coupling member for engaging said band-like member.

19. The connector assembly of claim 18 wherein said band-like member comprises a split ring member which is self-biased radially inwardly toward the other of said positions.

20. The connector assembly of claim 15 including spring means between said cam ring and said one connector member to urge the cam ring axially outwardly relative to the one connector member.

21. The connector assembly of claim 15 wherein said cam means on said cam ring comprises a cam ramp extending at an angle to the axis of said connector assembly.

22. The connector assembly of claim 15, including detent means between said cam ring and said one connector member providing an audible indication of the mating relation of said connector members.

23. The connector assembly of claim 22 wherein said detent means includes a plurality of detent recesses disposed in a radially extending, inwardly facing surface of said cam ring, and spring means on said one connector member having at least one detent protrusion providing a ratcheting action with said detent recesses.

24. In a connector assembly which includes first and second mating connector members, each connector member including engageable contact means, fibers, or the like, adapted for axial connection in engagement with the contact means, fibers, or the like, of the other connector member;

a coupling ring carried by one of said connector members;

said other connector member and said coupling ring having complementarily engageable releasable connecting means for moving the connector members axially into mating relation with each other; and visual indicating means associated with said coupling ring and movable radially relative thereto from a retracted position to an indicating position projecting outwardly of the coupling ring in response to a predetermined positioning of said other connector member in relation to the coupling ring, said visual indicating means including;

an outer band-like member extending substantially entirely about said coupling ring so as to provide an omni-directional visual indication of the relative positioning of said mating connector members, an inner cam ring carried by and having limited axial movement relative to said one connector member nd engageable by said other member to effect said axial movement thereof, and a plurality of ball bearings disposed in radially openended bores in said coupling ring between said inner cam ring and said outer band-like member and engageable therewith for transmitting movement of said inner cam ring to radial outward movement of said band-like member toward said indicating position.

25. The connector assembly of claim 24 wherein said band-like indicating member when in said retracted position is radially disposed at least within the adjacent peripheral bounds of said coupling ring.

26. The connector assembly of claim 24 wherein said band-like indicating member comprises a split ring member which is self-biased radially inwardly toward said retracted position.

27. The connector assembly of claim 26 including spring means between said cam ring and said one connector member to urge the cam ring axially outwardly relative to the one connector member toward the other connector member.

28. The connector assembly of claim 24 including detent means between said cam ring and said one connector member providing an audible indication of the mating relation of said connector members.

29. The connector assembly of claim 28 wherein said detent means includes a plurality of detent recesses disposed in a radially extending, inwardly facing surface of said cam ring, and spring means on said one connector member having at least one detent protrusion providing a ratcheting action with said detent recesses.

30. The connector assembly of claim 24 wherein said coupling ring is carried by said one connector member for rotation relative thereto, and said engageable releasable connecting means between said coupling ring and said other connector member is effective for moving the other connector member axially into mating relation to said one connector member in response to said relative rotation of said coupling ring.

31. The connector assembly of claim 24 wherein said band-like indicating member comprises an expandable split ring member which is self-biased radially inwardly toward said retracted position, the free ends of said expandable split ring being sufficiently overlapped so as to provide a full 360° peripheral indicating surface for the split ring when in its expanded indicating condition.

32. In a connector assembly including mating connector members, an expandable indicating band-like member comprising a split ring which is self-biased radially inwardly, means for moving said slit ring between a relaxed condition and an expanded condition in response to a predetermined mating condition of said connector members and the free ends of said expandable split ring being sufficiently overlapped so as to provide a full 360° periphery for the split ring in either said relaxed or said expanded condition.

33. The connector assembly of claim 32 including a pair of said connector members and a coupling member for mating said connector members, and wherein said expandable split ring is disposed within a circumferential peripheral groove of the coupling member and movable radially therein.

34. The connector assembly of claim 33 wherein said split ring when in said relaxed condition is disposed at least within the adjacent peripheral bounds of said coupling member.

35. The connector assembly of claim 34 wherein said split ring when in said expanded condition is disposed outside the adjacent peripheral bounds of the coupling member.

* * * * *